US008961269B2

(12) United States Patent
Zhang et al.

(10) Patent No.: US 8,961,269 B2
(45) Date of Patent: Feb. 24, 2015

(54) ABRASIVE WHEELS AND METHODS FOR MAKING AND USING SAME

(75) Inventors: Han Zhang, Shrewsbury, MA (US); Johannes Hermanus Kuit, Neede (NL); Robert Jitze Wilting, Rietmolen (NL)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 257 days.

(21) Appl. No.: 13/341,839

(22) Filed: Dec. 30, 2011

(65) Prior Publication Data

US 2012/0225611 A1 Sep. 6, 2012

Related U.S. Application Data

(60) Provisional application No. 61/428,587, filed on Dec. 30, 2010.

(51) Int. Cl.

| | |
|---|---|
| ***B24D 7/04*** | (2006.01) |
| ***B24D 18/00*** | (2006.01) |
| ***B24D 3/20*** | (2006.01) |

(52) U.S. Cl.

CPC ..... *B24D 18/00* (2013.01); *B24D 18/0009* (2013.01); *B24D 3/20* (2013.01)

USPC ..... 451/56; 451/533

(58) Field of Classification Search

CPC ..... B24D 18/0009

USPC ..... 451/56, 533, 342, 343, 360

See application file for complete search history.

(56) References Cited

U.S. PATENT DOCUMENTS

| | | | | | |
|---|---|---|---|---|---|
| 2,810,239 | A | * | 10/1957 | Burleigh | 451/342 |
| 3,136,100 | A | * | 6/1964 | Robertson, Jr. | 451/548 |
| 3,619,151 | A | | 11/1971 | Sheets, Jr. et al. | |
| 4,090,333 | A | | 5/1978 | Block et al. | |
| 4,918,116 | A | | 4/1990 | Gardziella et al. | |
| 5,031,361 | A | * | 7/1991 | MacKay, Jr. | 451/342 |
| 5,203,886 | A | | 4/1993 | Sheldon et al. | |
| 5,221,294 | A | | 6/1993 | Carman et al. | |
| 5,287,659 | A | * | 2/1994 | Timmons et al. | 451/342 |
| 5,429,648 | A | | 7/1995 | Wu | |
| 5,476,416 | A | | 12/1995 | Kodate | |

(Continued)

FOREIGN PATENT DOCUMENTS

| | | |
|---|---|---|
| JP | S3913293 B1 | 7/1939 |
| JP | S5035270 B1 | 11/1975 |

(Continued)

OTHER PUBLICATIONS

International Search Report from PCT/US2011/068233, dated Mar. 9, 2012, 2 pgs.

*Primary Examiner* — Maurina Rachuba

(74) *Attorney, Agent, or Firm* — Abel Law Group, LLP; Joseph P. Sullivan

(57) ABSTRACT

Bonded abrasive articles and in particular organic bonded depressed center wheels with one or more reinforcements have reduced stiffness in comparison to conventional counterparts. Techniques for producing and using such wheels are described. In one example, a method for reducing the stiffness of an organically bonded abrasive wheel includes applying to a raised hub region of a reinforced depressed center wheel a force effective to irreversibly decrease the stiffness of said wheel.

13 Claims, 7 Drawing Sheets

(56) References Cited

U.S. PATENT DOCUMENTS

| | | | | |
|---|---|---|---|---|
| 5,738,696 | A | 4/1998 | Wu | |
| 5,738,697 | A | 4/1998 | Wu et al. | |
| 6,383,064 | B1 | 5/2002 | Eggert et al. | |
| 6,685,755 | B2 | 2/2004 | Ramanath et al. | |
| 6,749,496 | B2 * | 6/2004 | Mota et al. | 451/546 |
| 6,755,729 | B2 | 6/2004 | Ramanath et al. | |
| 6,846,223 | B2 | 1/2005 | Conley et al. | |
| 6,942,561 | B2 | 9/2005 | Mota et al. | |
| 2002/0187737 | A1 | 12/2002 | Stuckenholz et al. | |
| 2010/0190424 | A1 | 7/2010 | Francois et al. | |
| 2013/0203327 | A1 * | 8/2013 | Rave et al. | 451/548 |

FOREIGN PATENT DOCUMENTS

| | | | |
|---|---|---|---|
| JP | 8090428 | A | 4/1996 |
| JP | 2001079771 | A | 3/2001 |
| JP | 2004299044 | A | 10/2004 |
| KR | 10-2010-0111114 | A | 10/2010 |

* cited by examiner

| | Pre-loading | Post-loading |
|---|---|---|
| A to B | Linear Region 1 | Linear Region 1 |
| B to G | Serration Region | |
| C to D | Linear Region 2 | Linear Region 2 |
| D to E | Linear Region 3 | Linear Region 3 |
| E | Fracture/rupture Point | Fracture/rupture Point |

| Serration Region Description | Shape |
|---|---|
| 1: zero slope |   |
| 2: slightly positive slope |   |
| 2: slightly negative slope |   |

ABRASIVE WHEELS AND METHODS FOR MAKING AND USING SAME

CROSS-REFERENCE TO RELATED APPLICATION(S)

The present application claims priority from U.S. Provisional Patent Application No. 61/428,587, filed Dec. 30, 2010, entitled "ABRASIVE WHEELS AND METHODS FOR MAKING AND USING SAME," naming inventors Han Zhang, Johannes Hermanus Kuit, and Robert Jitze Wilting, which application is incorporated by reference herein in its entirety.

BACKGROUND

Typically, bonded abrasive articles are prepared by blending abrasive grains with a bond and optional additives and shaping the resulting mixture, using, for instance, a suitable mold. The mixture can be shaped to form a green body which is thermally processed, for example, by curing, sintering and so forth, to produce an article in which the abrasive grains are held in a three dimensional bond matrix. Among bonded abrasive tools, abrasive (or grinding) wheels often are prepared utilizing an organic, e.g., a resin, bond. Such wheels can be reinforced using, for example, discs cut out of nylon, carbon, glass or cotton cloth, or can be un- or non-reinforced.

In some cases, a workpiece needs to be processed using a relatively stiff wheel. Other operations, however, are best conducted with wheels that are less stiff or more pliable, and one existing technique used to produce such wheels imparts a pattern on the working or the non-working face of the wheel. The pattern typically includes channels and protrusions, shaped, for instance in crisscross, annular or in another suitable arrangement.

A need continues to exist, however, for wheels that have reduced stiffness and for methods for making and using such wheels.

SUMMARY

The invention generally relates to bonded abrasive articles and in particular to organic bonded grinding/cutting wheels that have reduced stiffness, to methods for producing and to methods for using them.

In one aspect, the invention is directed to a method for reducing the stiffness of an organically bonded abrasive wheel. The method includes applying to a raised hub region of a reinforced depressed center wheel a force effective to irreversibly decrease the stiffness of said wheel. In another aspect, a method for reducing stiffness of a reinforced, organically bonded, depressed center abrasive wheel comprises deflecting the wheel by an amount calculated to produce a targeted stiffness.

In another aspect, the invention is directed to a process for producing a reinforced depressed center wheel. The process includes forming a green body in the shape of the depressed center wheel, e.g., at room or at an elevated temperature, said green body including one or more reinforcements; thermally processing the green body to obtain a cured product; and applying to the raised hub region of the cured product a load effective to irreversibly reduce the stiffness of the cured product, thereby producing the depressed center wheel.

Several aspects of the invention related to a wheel having reduced stiffness. In one implementation, a reinforced, organically bonded depressed center wheel has a stiffness that is at least 10% less than that of a comparative wheel of the same specification. The reduced stiffness wheel and the comparative wheel can have surfaces devoid of patterned features or can both have at least one patterned surface. For instance, in one example, both wheels have a working face (surface) devoid of patterned features. In another example, both wheels have a patterned working surface. In yet another example, both wheels have a patterned non-working surface. In another implementation, a reinforced organically bonded depressed center wheel has a stiffness reduction of at least about 10%, as calculated by the formula $[(Sc-Sn)/Sc]\times100\%$, wherein Sc is the stiffness of a corresponding conventional product and Sn is the measured stiffness of the reinforced organically bonded depressed center wheel, both Sc and Sn being measured under the same conditions. In a further implementation, a reinforced organically bonded depressed center wheel has (i) a pre-loading deflection-load curve that includes a serration region having a jagged profile and (ii) a post-loading deflection-load curve wherein said serration region is smoothed out. In yet another implementation, a reinforced organically bonded depressed center wheel specification has (i) a pre-loading deflection-load curve that includes a serration region having a jagged profile and (ii) a post-loading deflection-load curve wherein said serration region is smoothed out.

In one example, an organically bonded, reinforced, depressed center wheel that has no fiberglass web at the face of the wheel, exhibits a uniform deflection behavior within an initial regime of a load versus deflection plot, wherein the initial regime is defined by a region of the plot between 0% deflection (mm) and 70% deflection (mm), e.g., between 0% deflection (mm) and 50% deflection (mm), of the total deflection at the fractural load. In another example, an organically bonded, reinforced depressed center wheel exhibits a mechanical behavior having substantially no spontaneous deflection within an initial regime defined by a region of a plot of load versus deflection between 0% and 70%, e.g., between 0% and 60% or between 0% and 50%, of the total deflection at the fractural load. In a further example, an organically bonded, reinforced depressed center wheel (for instance a wheel having dimensions of 125×3.2×22.3 mm) exhibits an initial stiffness of less than 750 N/mm, wherein the initial stiffness is measured as a slope of a load versus deflection plot between 5 N and 150 N.

Further aspects of the invention relate to a method for using depressed center wheels such as those described herein. In one embodiment, a method for grinding a workpiece includes: attaching a depressed center wheel to an arbor of a grinding machine; rotating said wheel against a workpiece, thereby grinding said workpiece, wherein, the depressed center wheel exhibits an increase in Q-ratio with respect to a conventional wheel of the same specification, measured under the same grinding conditions. In another embodiment, a method for grinding a workpiece includes attaching a depressed center wheel to an arbor of a grinding machine; and rotating said wheel against a workpiece, thereby grinding said workpiece, wherein the depressed center wheel exhibits a decrease in sound level with respect to a conventional wheel of the same specification under the same grinding conditions.

In yet another aspect, the invention is directed to a method for determining a reduction in stiffness in a depressed center wheel. The method includes comparing a deflection-load curve for the depressed center wheel with a deflection-load curve for a conventional depressed center wheel of the same specification, wherein an absence of a serration region in the former and a presence of a serration region in the latter indicate that the depressed center wheel has reduced stiffness in comparison to said conventional depressed center wheel.

The invention has many advantages. In some of its embodiments, it provides a relatively simple technique for reducing the stiffness of a wheel. The technique can be integrated within an existing manufacturing process or can be conducted independently, e.g., post fabrication, on a finished product. Methods that are described herein can obviate the need for a patterned working or non-working surface yet do not require the absence of patterned features. Wheels according to aspects of the invention provide good wheel life and good Q-ratios. Furthermore, sound levels generated by operating wheels such as those described herein often are reduced and, in some cases, the wheels are accompanied by a shift of first mode of peak to lower frequency as well as a reduction of the peak height.

The above and other features of the invention including various details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Figure 1A:
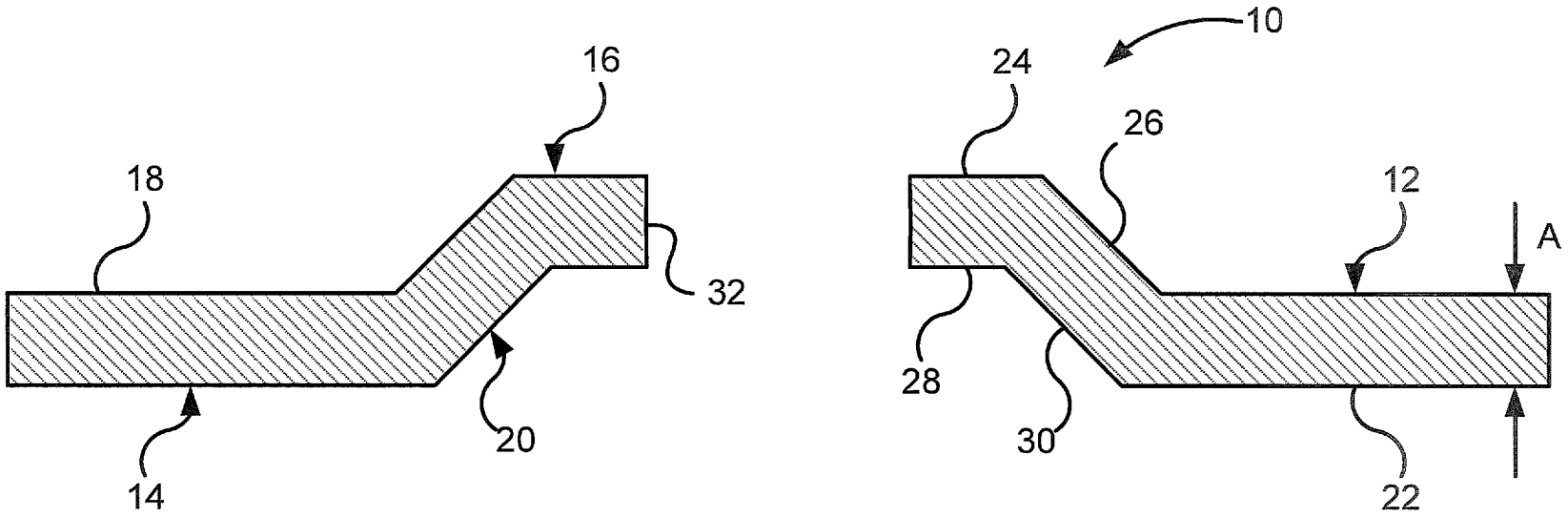
FIG. 1A is a cross-section view of a depressed center wheel.

The invention generally relates bonded abrasive articles and in particular to organic bonded grinding wheels that have reduced stiffness and methods for producing and using them.

In specific implementations, the wheels are depressed center wheels, such as, for example, ANSI (American National Standards Institute) Type 27, Type 28 or Type 29 wheels, or European Standard (EN 14312) Type 42 wheels. Shown in FIG. 1A, for instance, is a cross sectional view of depressed center abrasive wheel 10 which includes rear (top) face 12 and front (bottom) face 14. Rear face 12 includes raised hub region 16 and outer flat rear wheel region 18. Front face 14 includes depressed center region 20 and outer flat front wheel region 22 (which provides the working surface of the wheel). In turn, raised hub region 16 has raised hub surface 24 and back sloping (or slanted) surface 26; depressed center region 20 includes depressed center 28 and front sloping (or slanted) surface 30. Wheel 10 has central opening 32 for mounting the wheel on the rotating spindle of a tool, e.g., a hand-held angle grinder. During operation, wheel 10 typically is secured by mounting hardware (not shown in FIG. 1A) such as, for instance, a suitable flange system. The wheel can also be part of an integrated arrangement that includes mounting hardware.

Wheel 10 has a thickness A, measured, e.g., at the periphery of the wheel. In many designs the thickness of wheel 10 remains the same or essentially the same along a radial direction from the central opening to the outer edge (periphery) of the wheel. In other designs, the wheel thickness can vary (can increase or decrease) along a radial distance from the central opening to its periphery.

In many cases, the thickness of the wheel (e.g., A) is less than about 6.5 millimeters (mm), for example, 6 mm, 4.8 mm, 3.5 mm, 3.2 mm, 3 mm, 2.5 mm, 1.5 mm and is at least about 0.8 mm. Some aspects of the invention also can be practiced with wheels having a different thickness. In some cases, the depressed center wheels described herein are referred to as a "thin" wheel or hand-held, i.e., wheels that have a thickness no greater than 6.5 mm.

Various implementations of the invention can be practiced with depressed center wheels that have a patterned working surface. Shown in FIG. 1B, for instance, is a front view of depressed center wheel 150, having mounting hole 155, depressed center 151 and working surface 153, which can be patterned to have an array of protrusions 157 that are separated by recesses (or channels) 159. Other patterned arrangements can be employed, e.g., as known in the art.

Figure 1B:
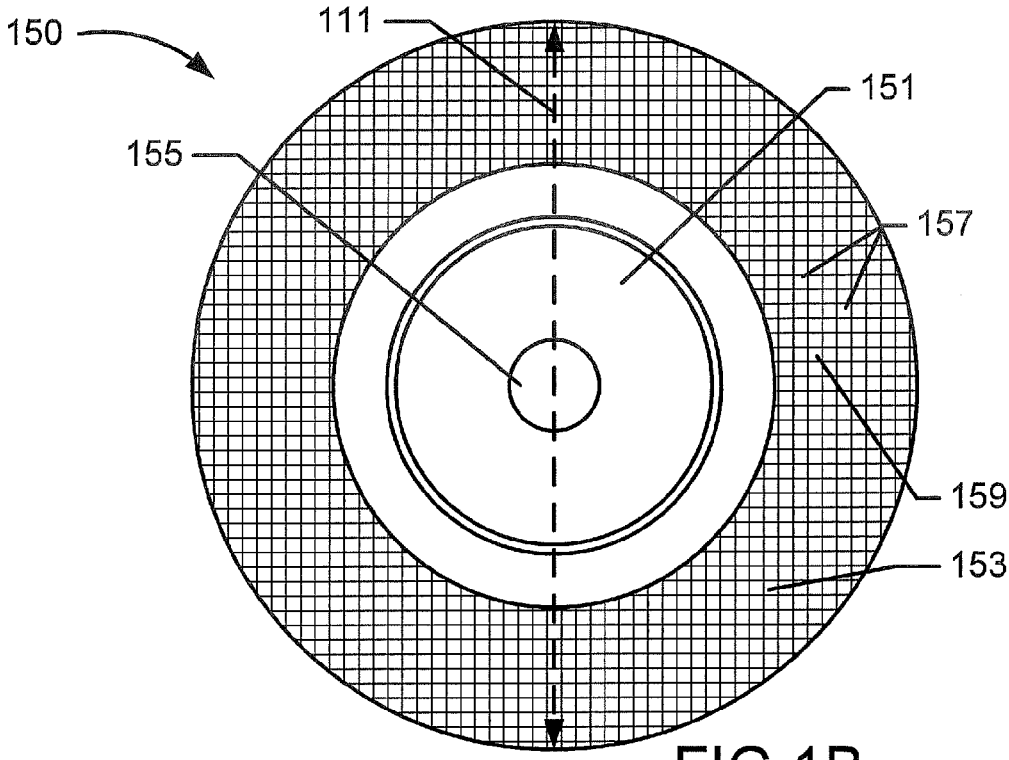
FIG. 1B is a view of a patterned working (front) face of a depressed center wheel.
Figure 1C:
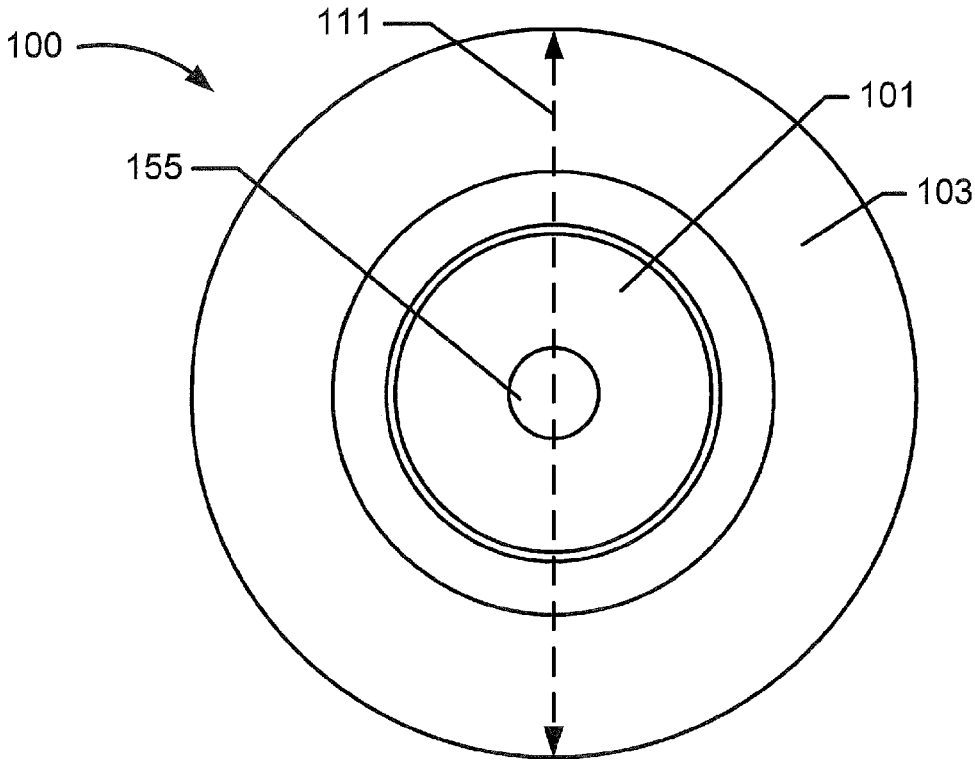
FIG. 1C is a view of a working (front) face of a depressed center wheel, the working face being devoid of patterned features.

In many embodiments, the depressed center wheel has a working surface that is devoid of patterned features. FIG. 1C, for instance, shows a front view of wheel 100, having depressed center 101, mounting hole 105 and working surface 103 which is smooth (not patterned). In other words, working surface 103 does not have protrusions or channels (recesses).

Depressed center wheels described herein can have an outer diameter 111 that is about 50 mm, such as at least about 75 mm. The diameter 111 may be greater, such as at least about 100 mm, at least about 115 mm, at least about 125 mm, or at least about 150 mm. In particular instances, diameter 111 is within a range between about 50 mm and 250 mm, such as between about 75 mm and about 230 mm.

Ratios between wheel diameter and wheel thickness (diameter:thickness) can be within a range between about 125:1 to about 15:1, e.g., between about 100:1 to about 30:1.

The invention can be practiced with wheels having different dimensions and different ratios between dimensions.

Figure 1D:
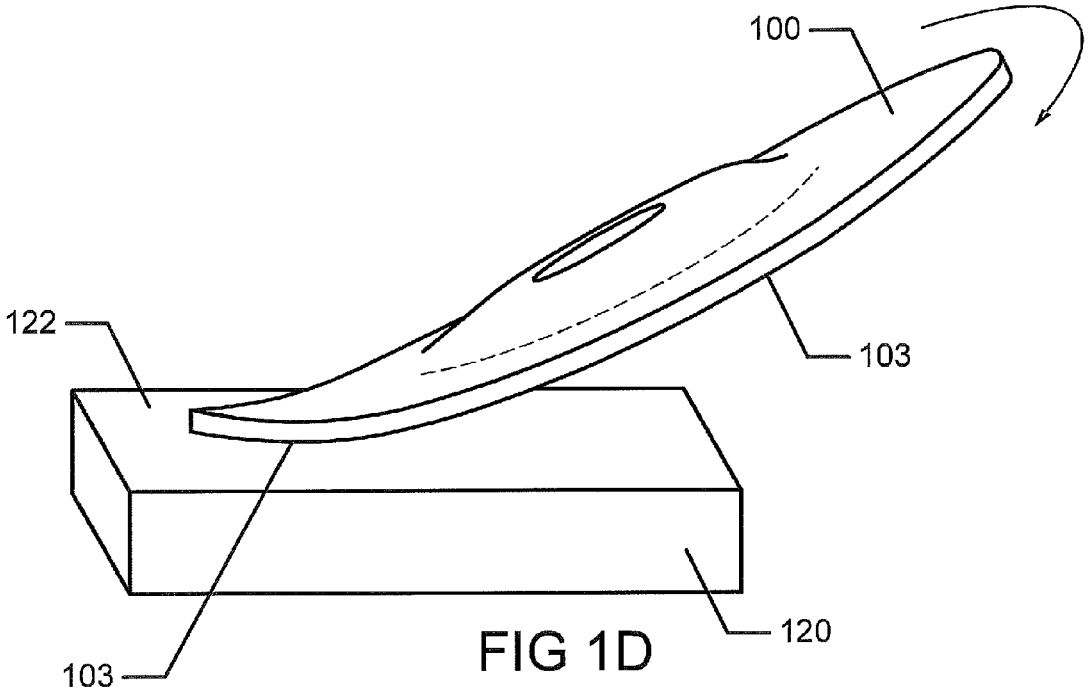
FIG. 1D is a view of a workpiece being processed by a compliant depressed center wheel.

Many aspects of the invention generally relate to wheels that have reduced stiffness. Such wheels are also referred to herein as pliable or compliant. Compliance of the wheel can be described by its ability to deflect, and wheels according to aspects of the invention are capable of limited deflection without breaking. As an illustration, shown in FIG. 1D is pliable or compliant depressed center wheel 100 being rotated, as indicated by the arrow, against surface 122 of workpiece 120. As outer portion 103 of wheel 100 contacts and grinds the workpiece, it can be deflected out of plane with the rest of the body of the wheel, thus enhancing contact with the workpiece being processed.

Compared to the stiffness of a corresponding conventional wheel, the abrasive wheel described herein has a reduced stiffness (e.g., of at least about 10%) as calculated by the formula [(Sc−Sn)/Sc]×100%, wherein Sc is the stiffness of a corresponding conventional product and Sn is the measured stiffness of an abrasive article according to embodiments disclosed herein, both Sc and Sn being measured under the same conditions.

The corresponding conventional (or comparative) product can be an abrasive article of the same specification as the wheel according to aspects of the invention. Wheel specifications are known in the art and are used to identify features such as wheel type, wheel composition, e.g., grain type, grit size, bond used, structure of the wheel, wheel hardness and so forth. Abrasive wheels also can be identified by their dimensions, manufacturer and/or other attributes, e.g., the presence or absence of reinforcement. In some implementations, the conventional wheel can be thought of as a wheel having a stiffness ordinarily associated with it, rather than the reduced stiffness of a wheel of the invention. In other implementations, the conventional wheel is a wheel that has not been subjected to a loading process according to embodiments described herein.

Another approach for drawing a comparison between wheels of the invention and a corresponding conventional wheel relies on the difference of their mechanical behavior of the deflection as exhibited by the deflection and force curve of the wheels. As further described below, a conventional wheel may exhibit a serration region (having a jagged appearance as shown by BC on plot 850 (grey line) in FIG. 4) in its curve; this serration region is smoothed out in the curve obtained for the corresponding wheel (or wheel specification according to aspects of the invention).

In some cases, a comparison also can be drawn using the interchangeability of wheels in conducting the same grinding operation on a particular material. The comparison also can be drawn with respect to the very same wheel, e.g., before (conventional) and after (e.g., increased pliability) the wheel is subjected to techniques described herein that are designed to reduce the stiffness of the wheel. In specific implementations, two wheels can be prepared in the same manner, utilizing the same formulation, geometry, reinforcement design and so forth. Using techniques described herein, the stiffness of the first wheel can be reduced in comparison to the second, "conventional" wheel (which is not subjected to these techniques).

Abrasive articles such as depressed center wheels according to embodiments disclosed herein have a decreased stiffness of at least about 10%, e.g., at least about 15% as compared to the corresponding conventional abrasive article. In yet other instances, the difference in stiffness can be greater, such that the stiffness can be at least about 20% less, at least about 30% less, at least about 40% less, at least about 50% less, at least about 60% less, at least about 70% less, at least about 75% less, at least about 80% less, even at least about 90% less, as compared to the conventional abrasive article. Still, embodiments herein can have a decrease in stiffness as compared to the conventional article within a range between about 10% and about 90%, such as between about 15% and about 85%, or even between about 20% and about 80% as compared to a conventional abrasive article.

Preferably, the depressed center wheel is reinforced with one, or more, e.g., two or three, reinforcements. As used herein, terms such as "reinforced" or "reinforcement" refer to a discrete layers or inserts or other such components made of a material that is different from the bond and abrasive mixture utilized to make the bonded abrasive wheel. Typically, the reinforcement material does not include abrasive grains. With respect to the thickness of the wheel, a reinforcement can be embedded within the wheel body and such wheels typically are referred to as "internally" reinforced. A reinforcement also can be close to, or attached to the front and/or back face of the wheel. Several reinforcements can be disposed at various depths through the wheel thickness.

Typical reinforcements have a circular geometry. The outer periphery of the reinforcement also can have a square, hexagon or another polygonal geometry. An irregular outer edge also can be used. Suitable non-circular reinforcement shapes that can be utilized are described in U.S. Pat. Nos. 6,749,496 and 6,942,561, both issued to Mota et al. on Jun. 15, 2004 and Sep. 13, 2005, respectively, and both being incorporated herein by reference in their entirety. In many cases, a reinforcement extends from the inner diameter (edge of the central opening) to the outermost edge of the wheel. Partial reinforcements also can be employed and in such cases, the reinforcement may extend, for example, from the inner wheel diameter (outer diameter of the central opening) to about 30%, 60%, 70%, 75%, 80%, 85%, 90% 95%, 99% along the wheel radius or, for non-circular shapes, along the equivalent of the largest "radius" of the reinforcement.

Various reinforcement materials can be used to reinforce the wheel and more than one type of reinforcement materials can be employed in a single wheel. Suitable reinforcements can be woven or non-woven, utilizing materials such as glass (C, E, or S2), Kevlar, Basalt, carbon, fabric organic materials (e.g., elastomers, rubbers), combinations of materials and so forth, but not limit to. Many aspects of the invention benefit from using reinforcements that allow for shear at the interface between the reinforcement and adjacent region(s) of the wheel (which contain abrasive grains distributed in a three dimensional bond matrix).

In specific examples, the wheel has at least one, e.g., two, fiberglass reinforcements, provided, for instance, in the form of fiberglass web(s). Typically, fiberglass webs are woven from very fine fibers of glass. Fiberglass web can be leno or plain woven.

The fiberglass utilized can be E-glass (alumino-borosilicate glass with less than 1 wt % alkali oxides. Other types of fiberglass, e.g., A-glass (alkali-lime glass with little or no boron oxide), E-CR-glass (alumino-lime silicate with less than 1 wt % alkali oxides, with high acid resistance), C-glass (alkali-lime glass with high boron oxide content, used for example for glass staple fibers), D-glass (borosilicate glass with high dielectric constant), R-glass (alumino silicate glass without MgO and CaO with high mechanical requirements), and S-glass (alumino silicate glass without CaO but with high MgO content with high tensile strength).

Fiberglass webs can be arranged in a bonded abrasive tool in any suitable manner. In many implementations, placement of a glass fiber web at the working face of the wheel is avoided. Many of the depressed center wheels described herein, are fully reinforced, with at least one of the fiberglass web having the similar inner diameter (corresponding to the diameter of the mounting hole) and the same outer diameter as the wheel. Partial web reinforcements that extend from the mounting hole through some but not all of the flat region of the wheel also can be used, as can be other web reinforcement placements.

Reinforcements can be characterized by one or more of the following physical parameters: weight (g/m$^2$), thickness (mm), openings per cm and tensile strength (MPa), which can be further broken down with respect to the tensile strength of the warp (the long web components that run continuously for the length of the roll) and the tensile strength of the fill (the short components that run crosswise to the roll direction). In many instances, one or more of the fiberglass webs employed has a minimum tensile strength of at least 200 MPa. Other factors include filament diameter, amount of coating, for instance, the coverage of the web with coating and others, as known in the art.

Chemical parameters can relate to the chemistry of the coating provided on the fiberglass web. Generally, there are two types of chemical "coatings". A first coating, often referred to as "sizing", is applied to the glass fiber strands immediately after they exit the bushing and includes ingredients such as film formers, lubricants, silanes, typically dispersed in water. The sizing typically provides protection of the filaments from processing-related degradation (such as abrasion). It can also provide abrasion protection during secondary processing such as weaving into a web. Strategic manipulation of properties associated with the first coating (sizing) can affect the compatibility of the glass fibers with the second coating, which, in turn, can affect compatibility of the coating with the resin bond. Typically, the second coating is applied to the glass web and traditionally includes wax, used primarily to prevent 'blocking' of the webs during shipping and storage. In many cases, the second coating is compatible with both the sizing (first coating) and the matrix resin for which the reinforcement is intended.

Bonded abrasive tools such as reinforced depressed center wheels, can be prepared by combining abrasive grains, a bonding material, e.g., an organic (resin), and in many cases other ingredients, such as, for instance, fillers, processing aids, lubricants, crosslinking agents, antistatic agents and so forth.

The various ingredients can be added in any suitable order and blended using, e.g., known techniques and equipment such as, for instance, Eirich mixers, e.g., Model RV02, Littleford, bowl-type mixers and others. The resulting mixture can be used to form a green body. As used herein, the term "green" refers to a body which maintains its shape during the next process step, but generally does not have enough strength to maintain its shape permanently; resin bond present in the green body is in an uncured or unpolymerized state. The green body preferably is molded in the shape of the desired article, e.g., a depressed center wheel (cold, warm or hot molding).

One or more reinforcements, e.g., fiberglass webs such as described herein, can be incorporated in the green body. For example, a first portion of a mixture containing abrasive grains and bonding material can be placed and distributed at the bottom of an appropriate mold cavity and then covered with a first reinforcement. A suitable reinforcement is a fiberglass mesh or web such as described above. A second portion of the bond/abrasive mixture can then be disposed and distributed over the first reinforcement layer. Additional reinforcement and/or bond/abrasive mixture layers can be provided, if so desired. The amounts of mix added to form a particular layer thickness can be calculated as known in the art. Other suitable sequences and/or techniques can be employed to shape the reinforced green body. For instance, a piece of paper or a fiberglass mesh or web or a piece of paper with a fiber glass mesh or web may be inserted in the mold cavity before the first mixture.

In some arrangements the various layers containing abrasive grains and bond (also referred herein as "mix layers") can differ from one another with respect to one or more characteristics such as, for instance, layer thickness, layer formulation (e.g., amounts and or types of ingredients being employed, grit size, grit shape, porosity and so forth). To form such a depressed center wheel, a first mix layer, $a_1$ (containing abrasive grains and bond), is laid at the bottom of the mold. A first reinforcement $V_1$ is laid on top, followed by a second layer, $a_2$, which can be the same or different from $a_1$. A second reinforcement, $V_2$ (which can be the same or different from $V_1$), is disposed over $a_2$. If desired, a third mix layer, $a_3$, that includes abrasive grains and bond can be used to cover $V_2$. The third layer can be the same or different with respect to $a_1$ and/or $a_2$. Additional reinforcements and layers can be added, essentially as described, to obtain the desired number of layers and reinforcements. In another approach, a first reinforcement $V_1$ is placed at the very bottom of the mold and covered by a first mix $a_1$, with additional layers and reinforcements being disposed as described above. Arrangements in which adjacent mix layers $a_x$ and $a_y$ are not separated by a reinforcement also are possible, as are those in which two or more reinforcement layers, e.g., $V_x$ and $V_y$, are not separated by a mix layer.

Figure 2A:
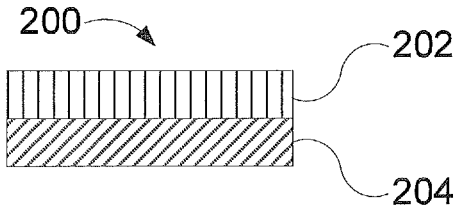
FIGS. 2A through 2E are cross-sectional views of a portion of the flat region of a depressed center wheel illustrating various arrangements of mix layers and reinforcements.
Figure 2B:
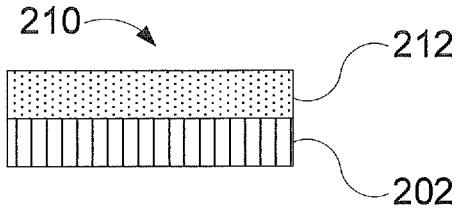
Figure 2C:
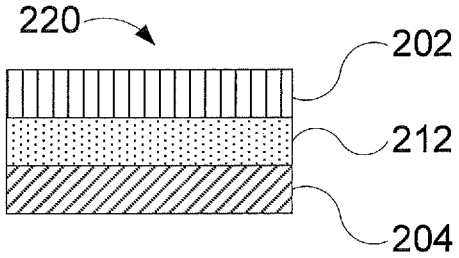
Figure 2D:
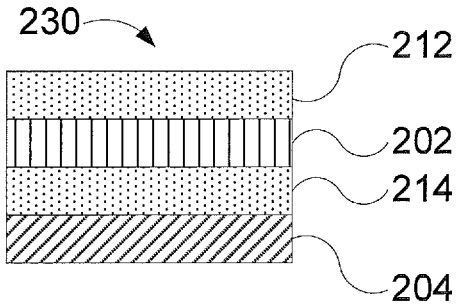
Figure 2E:
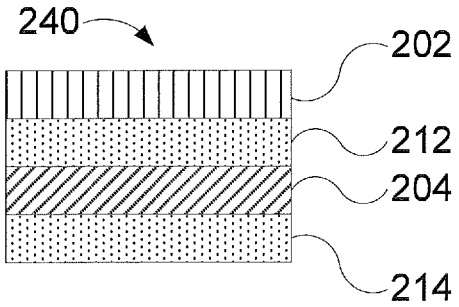

To illustrate, FIG. 2A is a cross-section of a portion of flat outer region 200 of a depressed center wheel having mix layers 202 and 204 and no reinforcement between them. The individual thicknesses of mix layers 202 and 204 can be substantially the same or can be different. For example, the difference in thickness between the mix layers can be at least about 5% different, at least about 10% different, at least about 20% different, at least about 25% different, at least about 30% different, or even at least about 50% different. FIG. 2B is a cross section of flat outer region 210 that includes one layer of reinforcements 212 and one mix layer 202. FIG. 2C is a cross section of flat outer region 220, which includes middle reinforcement 212 sandwiched between mix layers 202 and 204. FIG. 2D is a cross section of a portion of flat outer region 230 of a depressed center wheel having an alternating arrangement that includes reinforcement 212, mix layer 202, reinforcement 214 (which can be the same or different from reinforcement 212) and mix layer 204. FIG. 2E is a cross section of a portion of flat outer region 240 having an alternating arrangement which includes mix layer 202, reinforcement 212, mix layer 204 and reinforcement 214 at the working surface of the wheel. In many cases, the thickness of the reinforcement is less than that of any of the mix layers.

The individual thicknesses of the mix layers can be substantially the same. In certain instances, the thicknesses of the mix layers can be different, even significantly different. For example, the difference in thickness between two abrasive layers can be at least about 5% different, at least about 10% different, at least about 20% different, at least about 25% different, at least about 30% different, or even at least about 50% different. Engineered differences in the thicknesses between two abrasive layers can promote certain mechanical properties and advantages in grinding performance. In addition or alternatively to thickness variations, mix layers and/or reinforcements may differ with respect to formulation, materials employed and/or other properties.

Techniques that can be used to produce the bonded abrasive article, e.g., a reinforced depressed center wheel, include, for example, cold pressing, warm pressing or hot pressing. Cold pressing, for instance, is described in U.S. Pat. No. 3,619,151, which is incorporated herein by reference. During cold pressing, the materials in the mold are maintained at ambient temperature, e.g., normally less than about 30° centigrade (C). Pressure is applied to the uncured mass of material by suitable means, such as a hydraulic press. The pressure applied can be, e.g., in the range of about 70.3 kg/cm$^2$ (0.5 tsi) to about 2109.3 kg/cm$^2$ (15 tsi), and more typically in the range of about 140.6 kg/cm$^2$ (1 tsi) to about 843.6 kg/cm$^2$ (6 tsi). The holding time within the press can be, for example, within the range of from about 2.5 seconds to about 1 minute.

Warm pressing is a technique very similar to cold pressing, except that the temperature of the mixture in the mold is elevated, usually to a temperature below about 120° C., and more often, below about 100° C. Suitable pressure and holding time parameters can be, for example, the same as in the case of cold pressing.

Hot pressing is described, for example, in a Bakelite publication, Rutaphen™—Resins for Grinding Wheels—Technical Information. (KN 50E-09.92-G&S-BA), and in Another Bakelite publication: Rutaphen Phenolic Resins—Guide/Product Ranges/Application (KN107/e-10.89 GS-BG). Useful information can also be found in Thermosetting Plastics, edited by J. F. Monk, Chapter 3 ("Compression Moulding of Thermosets"), 1981 George Goodwin Ltd. in association with The Plastics and Rubber Institute. For the purpose of this disclosure, the scope of the term "hot pressing" includes hot coining procedures, which are known in the art. In a typical hot coining procedure, pressure is applied to the mold assembly after it is taken out of the heating furnace.

To illustrate, an abrasive article can be prepared by disposing layers of a mixture including abrasive grains, bond material and, optionally, other ingredients, below and above one or more reinforcement layer(s) in an appropriate mold, usually made of stainless-, high carbon-, or high chrome-steel. Shaped plungers may be employed to cap off the mixture. Cold preliminary pressing is sometimes used, followed by preheating after the loaded mold assembly has been placed in an appropriate furnace. The mold assembly can be heated by any convenient method: electricity, steam, pressurized hot water, hot oil or gas flame. A resistance- or induction-type heater can be employed. An inert gas like nitrogen may be introduced to minimize oxidation during curing.

The specific temperature, pressure and time ranges can vary and will depend on the specific materials employed, the type of equipment in use, dimensions and other parameters. Pressures can be, for example, in the range of from about 70.3 $kg/cm^2$ (0.5 tsi) to about 703.2 $kg/cm^2$ (5.0 tsi), and more typically, from about 70.3 $kg/cm^2$ (0.5 tsi) to about 281.2 $kg/cm^2$ (2.0 tsi). The pressing temperature for this process is typically in the range of about 115° C. to about 200° C.; and more typically, from about 140° C. to about 190° C. The holding time within the mold is usually about 30 to about 60 seconds per millimeter of abrasive article thickness.

A bonded abrasive article is formed by curing the organic bonding material. As used herein, the term "final cure temperature" is the temperature at which the molded article is held to effect polymerization, e.g., cross-linking, of the organic bond material, thereby forming the abrasive article. As used herein, "cross-linking" refers to the chemical reaction(s) that take(s) place in the presence of heat and often in the presence of a cross-linking agent, e.g., "hexa" or hexamethylenetetramine, whereby the organic bond composition hardens. Generally, the molded article is soaked at a final cure temperature for a period of time, e.g., between 6 hours and 48 hours, e.g., between 10 and 36 hours, or until the center of mass of the molded article reaches the cross-linking temperature and desired grinding performance (e.g., density of the cross-link).

Selection of a curing temperature depends, for instance, on factors such as the type of bonding material employed, strength, hardness, and grinding performance desired. In many cases the curing temperature can be in the range of from about 150° C. to about 250° C. In more specific embodiments employing organic bonds, the curing temperature can be in the range of about 150° C. to about 230° C. Polymerization of phenol based resins, for example, generally takes place at a temperature in the range of between about 110° C. and about 225° C. Resole resins generally polymerize at a temperature in a range of between about 140° C. and about 225° C. and novolac resins generally at a temperature in a range of between about 110° C. and about 195° C.

To illustrate, a green body for producing a reinforced bonded abrasive article may be pre-heated to an initial temperature, e.g., about 100° C. where it is soaked, for instance, for a time period, from about 0.5 hours to several hours. Then the green body is heated, over a period of time, e.g. several hours, to a final cure temperature where it is held or soaked for a time interval suitable to effect the cure. Once the bake cycle is completed, the abrasive article, e.g., the reinforced depressed center wheel, can be air-cooled. If desired, subsequent steps such as edging, finishing, truing, balancing and so forth, can be conducted according to standard practices.

In one embodiment, the invention is directed to a method for reducing the stiffness of an organically bonded depressed center wheel. In this method, also referred to herein as "loading", "loading process", "loading method" or "loading technique", the stiffness of a wheel is reduced by applying a force to the hub region, e.g., hub surface (FIG. 1A at surface 24). Loading can be integrated in a fabrication process using, e.g., a cold or warm or hot pressing process such as described above. For example, the method can be conducted after the bake cycle is completed. The method can also be conducted on a finished product.

In preferred implementations, the loading process is conducted on a state-of-art machine, e.g., an apparatus equipped with a computer to control the loading speed, load amount or wheel deflection precisely; to record deflection versus load curve, and to calculate the stiffness after the loading process. In other approaches, the loading process can also be conducted on a simple mechanical set-up with a load-cell or pressure sensor to control the pressure or load applied on either wheel hub region or wheel working surface area.

The method can also be conducted independently from the manufacturing process of a wheel, e.g., using an existing finished product, such as, for example, a commercially available depressed center wheel.

In the loading method, a force (load) is applied to the raised hub region, for instance at surface 24 (FIG. 1A) of a reinforced depressed center wheel which can have a smooth or a patterned working face. Loading also can be practiced with wheels that have a smooth or a patterned non-working face. In many cases, no fiberglass web reinforcement is present at the working face of the wheel.

The force can be applied in a single cycle, burst or impulse, lasting for a time interval such as, for example, in the range of 1 s to 5 minutes, or repeatedly, at the same load value or using different load values. Several, e.g., five, pulses or cycles can be used to apply the force (also referred to herein as "pulsed loading") to the hub region of the wheel. In scale-up facilities, using a single or a small number of load cycles (load pulses) reduces production time and promotes manufacturing efficiency.

Figure 3:
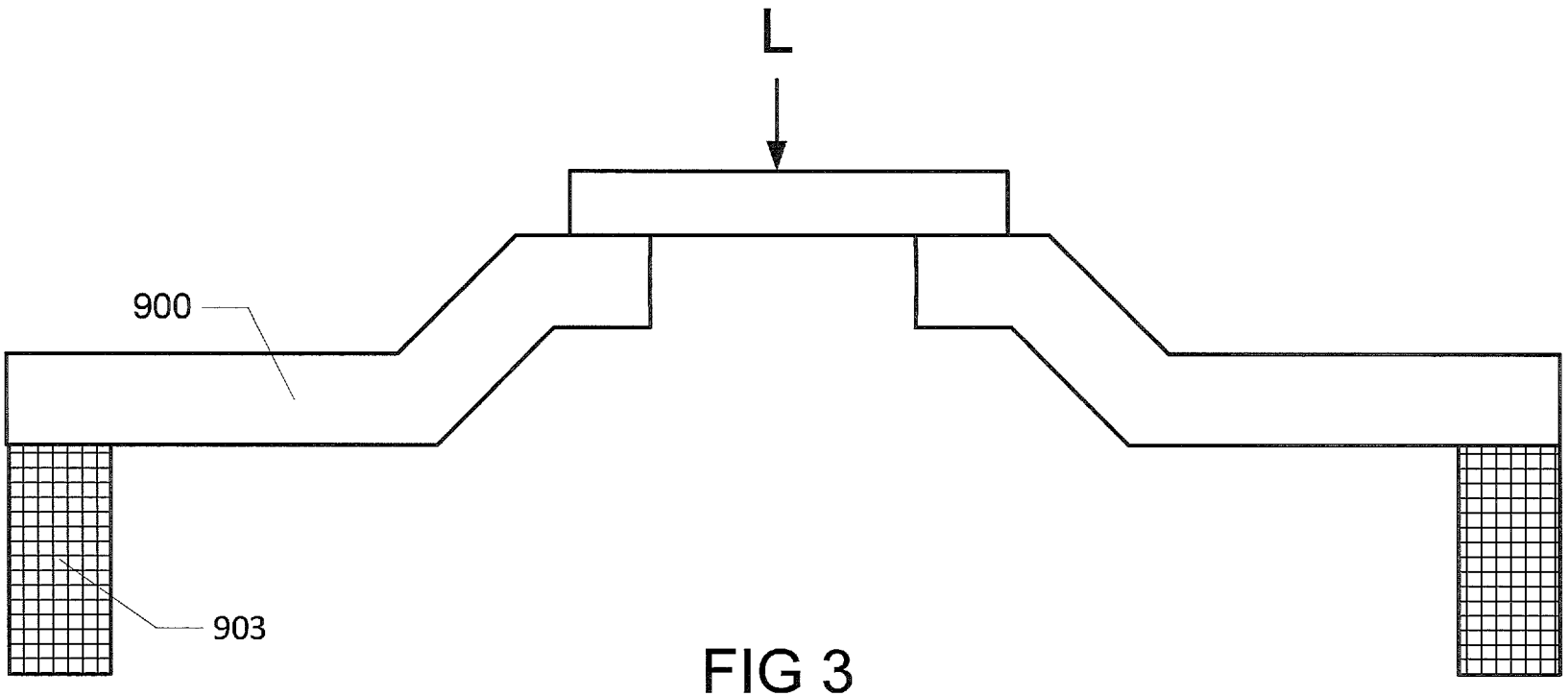
FIG. 3 is a schematic diagram of an arrangement that can be used to exert a force at a raised hub region of a depressed center wheel.

In specific embodiments, a force or load can be applied using an arrangement such as that illustrated in FIG. 3. As shown in this drawing, depressed center wheel 900 is supported at its periphery by a platen, e.g., a rigid cylinder 903. The abrasive article is subjected to a force or load (L) which is exerted as illustrated. The load can be a static or variable. That is, a single static load value can be applied to the abrasive article 900. Alternatively, the load can vary, such as from an initial load value to a final load value, wherein the initial load value may be smaller than the final load value. In specific examples, the equipment is designed to facilitate the application of a uniform force across the hub surface.

The force (load) applied is such that it is effective in imparting a permanent (irreversible) reduction in wheel stiffness without changing the mechanical integrity of the wheel. Generally, the load is lower than the wheel fractural (rupture) load (corresponding to the load where the wheel fails or to the force required to rupture or to break the wheel). Below the wheel fractural load, some load values are too small to result in an irreversible reduction in stiffness and after such a load is exerted on the raised hub region of the wheel, the wheel simply returns to its original (initial) state. At and above a certain level, referred to herein as "the critical load", the stiffness of the wheel can be irreversibly reduced, rendering the wheel (more) pliable. This property is maintained through one or repeated use, and preferably throughout the life of the wheel.

The force to be applied can be determined, for example, by placing the wheel on a solid stand, followed by a gradual loading process applied from the hub region of the wheel to allow the wheel to deflect until a desired stiffness reduction is reached. In another approach, one starts by first determining one or more deflection values for the wheel, calculated based on the targeted stiffness. For a given depressed center wheel or wheel specification, W, for instance, a targeted stiffness X (N/mm) may be correlated by calculations to the deflection Y (mm) that needs to be applied to obtain stiffness X. Once determined, the force is then applied to the hub region, (e.g., hub surface 24 in FIG. 1A) to reduce the stiffness of the wheel until the targeted deflection amount is reached (bearing in mind the fractural load and/or any safety margins applicable to the given wheel or wheel specification).

Typically, the loading method described herein reduces the elastic modulus of the product, resulting in improved grinding performance and lower noise levels compared to a conventional product (e.g., a product that was not subjected to the loading technique).

For example, depressed center wheels according to embodiments described herein may have improved performance characteristics. In many implementations, such wheels exhibit improved wheel life over comparable state-of-the-art wheels. For instance, the abrasive article can exhibit a Q-ratio, which is a measure of material removed from a workpiece (weight) divided by the material lost from the body of the abrasive article (weight) that is an improvement (i.e., relative Q-ratio) of at least about 5% as compared to a conventional equivalent. The relative Q-ratio can be calculated by the formula $[(Qn-Qc)/Qc]\times 100\%$, wherein Qc is the Q-ratio of the conventional product and Qn is the measured Q-ratio of the abrasive article according to embodiments described herein under the same (or essentially the same) grinding conditions.

The Q-ratio can be measured by mounting the abrasive article on a portable angle grinding machine having a maximum operation speed of about 80 m/s. A workpiece material with typical dimensions (e.g., 300 mm (length)×100 mm (width)×20 mm (thickness)) and a known weight is clamped and readied for grinding. The weight of the workpiece material can be recorded into a computer system along with the diameter and weight of the abrasive article. An operator then conducts grinding or cutting operations on the workpiece. A data acquisition system connected to the angle grinding machine can be used to monitor the power and current of the grinder, and the grinding time during testing. Testing lasts until the working area of the abrasive article is fully consumed. After the abrasive article is consumed, the remaining diameter and weight of the tested abrasive article are measured and recorded. The weight of the remaining workpiece material is weighed and recorded as well. The computer system, using a suitable software application, determines material removal rate (MRR) and wheel wear rate (WWR). The application calculates the absolute Q-ratio by dividing MRR by WWR.

Certain abrasive articles of embodiments described herein can have a relative Q-ratio of at least about 5% or 10% greater, e.g., at least about 20% greater, at least about 30% greater, at least about 40% greater, or at least about 50% greater as compared to the conventional abrasive article. Particular embodiments can have a relative Q-ratio value within a range between about 5% and about 100%, such as between about 20% and about 100%, or even between about 20% and about 90% as compared to the conventional abrasive article.

Implementations of the invention also result in improvements with respect to acoustic properties associated with the grinding operation and in many cases, the grinding operation exhibits lower noise levels. In an illustrative set-up, noise level is measured with a sound meter Type 2250 manufactured by Brüel & Kjær with software of BZ-7222. It is a class 1 sound meter corresponding to the requirements of the standardized test IEC 61672-1. The sound microphone is placed on a metal tripod one meter above the ground level and one meter away from the operating location. The room temperature during testing is 25° C. The recorded noise level is an average of the weighted noise level dB(A) over 5 to 20 kHz frequency band for 30 seconds of grinding time. The workpiece material for testing is 304 stainless steel. The grinder used is a Bosch GWS-10 angle grinder with 1020 W operated at 11000 rpm.

In specific instances, the abrasive articles herein demonstrate a reduction in noise (i.e., relative change in noise during grinding) of at least about 1 dB as compared to a conventional abrasive article. The noise reduction (NR) can be represented by the equation NR=[dBc−dBn], wherein dBc is the decibels of the conventional product measured in the conditions noted herein and dBn is the measured noise in decibels of an abrasive article according to an embodiment as measured in the conditions noted herein. According to one embodiment, the abrasive articles of embodiments herein can have a reduction in noise that is at least about 2 dB, at least about 2.5 dB, at least about 3 dB, or even at least about 4 dB. In particular instances, the abrasive wheels described herein can have a reduction in noise within a range between about 1 dB and about 10 dB, or between about 1 dB and about 5 dB as compared to the conventional abrasive article.

In some cases, the wheels are accompanied by a shift of first mode of peak to lower frequency as well as a reduction of the peak height.

Specific aspects of the invention relate to generating, for a given wheel or wheel specification, a plot of deflection (deflection) as a function of the load exerted. An Instron machine can be utilized to apply a load of, for example, 150 N at a rate of 1.5 mm/min or higher at a region adjacent to the central opening. During the stiffness testing and while a load is being applied, a cylindrical support is contacting the working surface of the abrasive article. The cylindrical support contacts the abrasive article throughout a full circumference at a location on the working surface closest to the peripheral edge of the abrasive article that defines a surface between the working surface and top surface. As the load is applied, the load versus deflection data can be collected to generate a load-deflection curve. In automated implementations, the data are collected by a computer and a load-deflection curve is plotted automatically using a computer program (e.g., a spreadsheet program). The slope of the load-deflection curve, measured in Newtons (N) per mm, can be determined through the linear curve fitting techniques (e.g., computer program) and represents the measured absolute stiffness of the abrasive article. Relative stiffness is the ratio of the absolute stiffness of an abrasive article as compared to the absolute stiffness of the conventional abrasive article (e.g., not subjected to the loading method described herein). The relative stiffness can be utilized to compare the stiffness change.

Curves (plots) generated as described herein can help in determining one or more of the following: whether the stiffness of the wheel can be reduced using the techniques described herein; the value of a suitable force range that can be applied to yield a permanent or irreversible decrease in the stiffness of the wheel; effects of wheel construction, thickness, wheel geometry, reinforcement properties, ratio of reinforcement (e.g., fiber web) to the mix and so forth on critical load.

Figure 4:
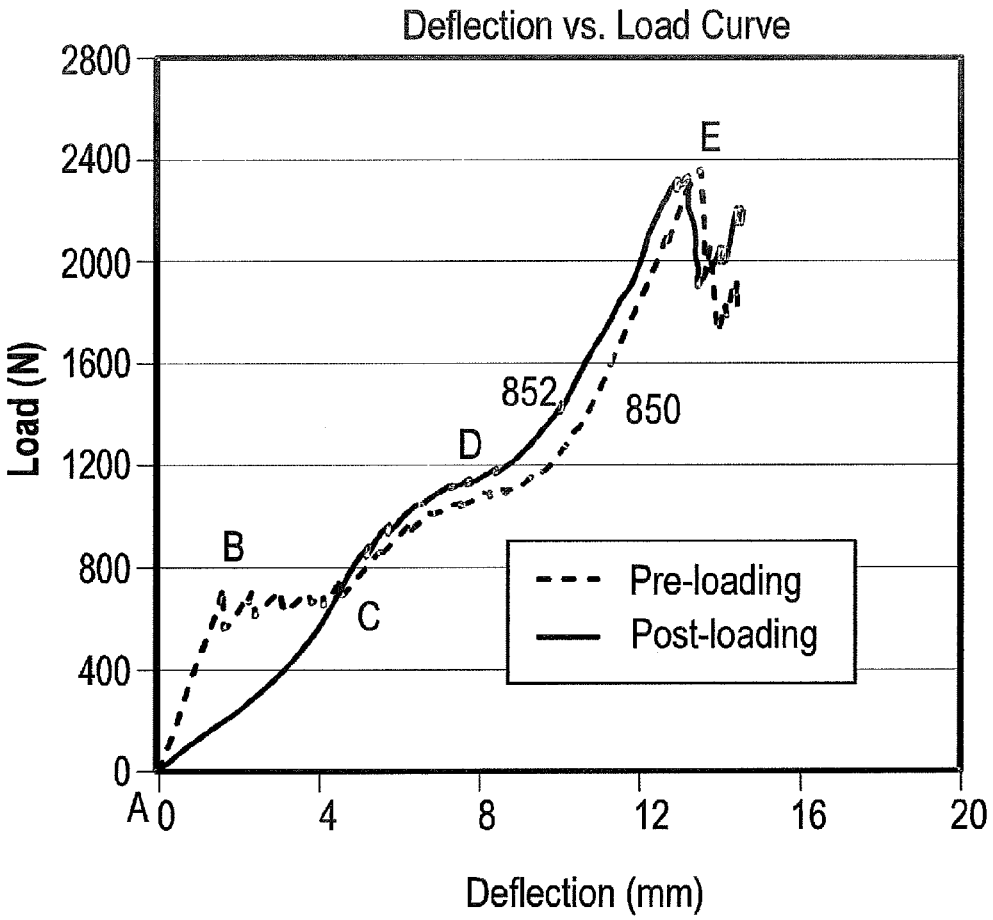
FIG. 4 shows two deflection versus load plots illustrating the influence of the loading process on mechanical behavior.

To illustrate, plots 850 (grey line) and 852 (black line) in FIG. 4 show the deflection in mm as a function of load value being applied (in Newton) for organically bonded depressed center wheels with two reinforcements having a layered arrangement such as that shown in FIG. 2D and a patterned working face. Plot 850 shows the behavior of a depressed center wheel not subjected to loading (conventional wheel) up to fracture. Plot 852 shows the post loading behavior of the wheel (wheel according to embodiments of the invention) up to fracture.

Plot 850 of the (conventional) depressed center reinforced wheel not subjected to the loading process (grey line in FIG. 4) includes an elastic linear regime (A to B); a serration regime (B to C); a linear region 2 (C to D); a linear region 3 (D to E), and a point E characterized by macro-fractures. Also shown on the plot are the critical load C and the wheel fracture load E. Plot 852 shows the post loading behavior of the reinforced depressed center wheel (corresponding to a wheel according to embodiments of the present invention) up to fracture.

As seen in FIG. 4, the conventional abrasive article demonstrates a substantially non-uniform deflection behavior within an initial regime, (see serration region B to C for up to about 4.8 mm deflection on plot 850). This non-uniform deflection behavior is identified as a region of the plot characterized by a jagged line, or more particularly, a region of the curve that can be more easily defined by two or more slopes of a curve as opposed to a single curve. The initial regime is a region of the plot that represents the initial stiffness behavior of the abrasive article as it is initially going through the loading process according to the loading parameters detailed herein. The initial regime can be more suitably defined as the region of the plot between 0% deflection and 70% deflection of the total deflection of the body, wherein 100% deflection is measured as the point at which a fractural load is applied and the abrasive article fails. The initial regime can also be defined as a region of the plot between 0% load (N) and 60% of the fractural load of the abrasive body, wherein the fractural load is the load at which the abrasive article fractures and fails.

The conventional abrasive article undergoes an initial deflection that is quite small with a substantial increase in load, demonstrating limited deflection. After a certain initial critical load is applied, the behavior of the conventional abrasive changes distinctly and the body undergoes non-uniform and abrupt deflection behavior, wherein the amount of deflection increases dramatically with little to substantially no change in the applied load.

In contrast to the serration region discussed above, plot 852 (post-loading behavior of the wheel) demonstrates uniform deflection behavior (see smooth curve) in the initial regime. More specifically, plot 852 exhibits a single, smooth curve demonstrating continuous deflection with increasing load within the initial regime, as opposed to a curve that exhibits two distinct behaviors defining non-uniform deflection behavior, wherein the load increases sharply with little deflection, and then "spontaneous deflection behavior" wherein the deflection increases sharply with little to no applied load.

Figure 5:
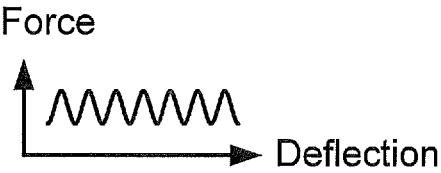
FIG. 5 is an illustration of shapes associated with serration regions having a zero slope, a slightly positive and slightly negative slope.
Figure 5:
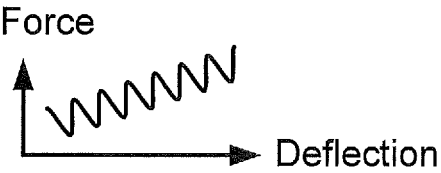
Figure 5:
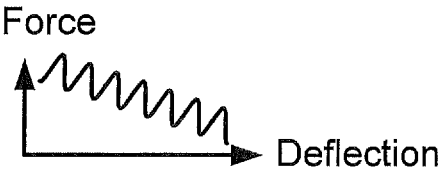

In a plot of force versus deflection, the serration region (if present) can have a slope that is essentially zero, a slightly positive slope or a slightly negative slope. A visual depiction of shapes associated with each situation is provided in FIG. 5.

While the loading method described herein can yield a more compliant abrasive wheel, it does not substantially change its characteristic fracture load (see point E in FIG. 4) or its burst strength.

Correlations of wheel stiffness as a function of load applied can be generated. As an example, Table A presents values of wheel stiffness as a function of load applied, showing a decrease in stiffness with increased loading after the applied loads exceed the critical load. Stiffness reduction generally is a function of the load employed, while the critical load is related to one or more factors such as wheel formulation, wheel construction, wheel thickness, wheel geometry, ratio of amount of fiber web (if such is employed as a reinforcement) to the mix and so forth. In many implementations, the load selected to reduce the stiffness of the wheel is well below the rupture load, e.g., within a region also referred to herein as "serration region", illustrated in FIG. 4 by the B to C region. Once determined, the load value can be integrated in a production line where wheels of the same specification as the one tested can be rendered more compliant using the loading method described herein as a step in the overall wheel fabrication process.

TABLE A

| Load (N) | Stiffness (Pre-Loading, N/mm) | Stiffness (Post-Loading, N/mm) | Stiffness |
|---|---|---|---|
| 0 | 476 | 476 | 0% |
| 250 | 548 | 549 | −0.2% |
| 750 | 516 | 159 | 69.1% |
| 1250 | 469 | 87 | 81.4% |
| 1750 | 469 | 63 | 86.6% |

In specific examples, loading decreases the initial stiffness of a wheel by at least about, 10%, by at least about 20%, by at least about 30%, by at least about 40%, by at least about 50%, by at least about 60%, or even by at least about 80% as compared to the conventional abrasive article. The "initial stiffness" refers to the same abrasive article without applying the loading process described herein and generally depends on factors related to wheel formulation, geometry, dimension, modulus, and measurement technique of the wheel.

Particular embodiments exhibit a decrease in initial stiffness within a range between about 10% and about 90%, such as between about 30% and about 90%, or even between about 50% and about 90% of the initial stiffness of the conventional abrasive article. In many implementations, the stiffness that can be achieved is up to 10 times less than that of the comparative wheel.

In some implementations, the abrasive articles can have an initial stiffness of less than 1000 N/mm, wherein the initial stiffness is measured as a slope of a plot of load versus deflection for the body between 5 N and 150 N. In other embodiments, the initial stiffness can be less, such as less than 1000 N/mm, less than about 750 N/mm, less than about 500 N/mm, less than about 400 N/mm, less than about 350 N/mm, or even less than about 250 N/mm. In particular instances, the abrasive articles of embodiments herein can have an initial stiffness within a range between about 250 N/mm and about 900 N/mm, such as between about 250 N/mm and about 850 N/mm, such as between about 250 N/mm and about 800 N/m, or even between about 250 N/mm and about 750 N/mm.

The initial stiffness of the wheel is a function of formulation, geometry, dimension, thermal curing, porosity content, and modulus of the wheel. Generally, the presence of a serration region, such as, for example, serration region 804 in FIG. 4, indicates that the stiffness of the wheel can be irreversibly (permanently) reduced using techniques described herein; the absence of a serration region indicates that the wheel typically cannot be rendered more pliable using these techniques. Design and/or wheel parameters such as wheel thickness, geometry, wheel construction, wheel structure, reinforcement design, and others can be manipulated to influence the critical load.

For instance, the method described herein can be practiced with thinner (e.g., 1.5 mm) as well as with thicker wheels (e.g., 6 mm) but the latter may require a higher load and more reinforcements to achieve the same pliability as the former.

Generally, the loading technique described herein will not apply to un-reinforced wheels. In many cases, good stiffness reductions are obtained using a design that has one (e.g., middle or non-working surface) reinforcement or a design that utilizes two reinforcements (as shown, for example in FIG. 2D). In many cases, arrangements that have a fiberglass web reinforcement at the working face of the wheel (as shown, e.g., in FIG. 2E) are avoided.

Reinforcement materials that promote sufficient strengthening of the mix layer(s) are preferred. In many implementations, the fiberglass web (if such a web is employed as reinforcement) has a tensile strength of at least 200 MPa.

The presence or absence of patterned features at the working surface has a minor or no effect on the maximum deflection that can be achieved. Thus the approach described herein can obviate the need for a patterned working face. In some instances, the absence of a patterned working surface requires a higher load to obtain the same reduction in stiffness.

With respect to the wheel formulation, suitable abrasive grains that can be employed include, for example, alumina-based abrasive grains. As used herein, the term "alumina," "$Al_2O_3$" and "aluminum oxide" are used interchangeably. Many alumina-based abrasive grains are commercially available and special grains can be custom made. Specific examples of suitable alumina-based abrasive grains which can be employed in the present invention include white alundum grain, from Saint-Gobain Ceramics & Plastics, Inc. or pink alundum, from Treibacher Schleifmittel, AG, monocrystal alumina, coated or non-coated brown fused alumina, heat treated alumina, silicon carbide or combinations thereof. Other abrasive grains such as, for instance, seeded or unseeded sintered sol gel alumina, with or without chemical modification, such as rare earth oxides, MgO, and the like, alumina-zirconia, boron-alumina, diamond, cubic boron nitride, aluminum-oxynitride, and others, as well as combinations of different types of abrasive grains also can be utilized. In one implementation, at least a portion of the grains employed are wear-resistant and anti-friable alumina-zirconia grains produced by fusing zirconia and alumina at high temperatures (e.g., 1950° C.). Examples of such grains are available from Saint-Gobain Corporation under the designation of ZF® and NZ®. The wear-resistant and anti-friable alumina-zirconia grains can be combined, for example, with sintered bauxite (e.g., 76 A) grains, ceramic coated fused alumina grains, fused aluminum oxide grains special alloyed with C and MgO and having angular grain shape (e.g., obtained from Treibacher Schleifmittel, AG under the designation of KMGSK) and other abrasive materials. Abrasive grains also can be made from other suitable inorganic materials such as oxides, carbides, nitrides, borides, or any combination thereof.

The size of abrasive grains often is expressed as a grit size, and charts showing a relation between a grit size and its corresponding average particle size, expressed in microns or inches, are known in the art as are correlations to the corresponding United States Standard Sieve (USS) mesh size. Grain size selection depends upon the application or process for which the abrasive tool is intended. Suitable grit sizes that can be employed in various embodiments of the present invention range, for example, from about 16 (corresponding to an average size of about 1660 micrometers (μm)) to about 220 (corresponding to an average size of about 32 μm). Different sizes also can be used. Various grain shapes (spherical, elongated, irregular and others) or combinations of shapes can be utilized.

In specific implementations of the present invention, the bond is an organic bond, also referred to as a "polymeric" or "resin" bond, typically obtained by curing a bonding material. An example of an organic bonding material that can be employed to fabricate bonded abrasive articles includes one or more phenolic resins. Such resins can be obtained by polymerizing phenols with aldehydes, in particular, formaldehyde, paraformaldehyde or furfural. In addition to phenols, cresols, xylenols and substituted phenols can be employed. Comparable formaldehyde-free resins also can be utilized.

Among phenolic resins, resoles generally are obtained by a one step reaction between aqueous formaldehyde and phenol in the presence of an alkaline catalyst. Novolac resins, also known as two-stage phenolic resins generally are produced under acidic conditions and during milling process blended with a cross-linking agent, such as hexamethylenetetramine (often also referred to as "hexa").

The bonding material can contain more than one phenolic resin, e.g., at least one resole and at least novolac-type phenolic resin. In many cases, at least one phenol-based resin is in liquid form. Suitable combinations of phenolic resins are described, for example, in U.S. Pat. No. 4,918,116 to Gardziella, et al., the entire contents of which are incorporated herein by reference.

Examples of other suitable organic bonding materials include epoxy resins, polyester resins, polyurethanes, polyester, rubber, polyimide, polybenzimidazole, aromatic polyamide, modified phenolic resins (such as: epoxy modified and rubber modified resins, or phenolic resin blended with plasticizers etc.), and so forth, as well as mixtures thereof. In a specific implementation, the bond includes phenolic resin.

The mixture can also include fillers, curing agents and other compounds typically used in making organic-bonded abrasive articles. Any or all of these additional ingredients can be combined with the grains, the bonding material or with a mixture of grain and bonding material.

Fillers may be in the form of a finely divided powder, granules, spheres, fibers or some otherwise shaped materials. Examples of suitable fillers include sand, silicon carbide, bubble alumina, bauxite, chromites, magnesite, dolomites, bubble mullite, borides, titanium dioxide, carbon products (e.g., carbon black, coke or graphite), wood flour, clay, talc, hexagonal boron nitride, molybdenum disulfide, feldspar, nepheline syenite, various forms of glass such as glass fiber and hollow glass spheres and others, CaF2, KBF4, Cryolite (Na3AlF6) and PotassiumCryolite. (K3AlF6), Pyrites, ZnS, Copper sulfides. Mixtures of more than one filler are also possible. Other materials that can be added include processing aids, such as: antistatic agents or metal oxides, such as lime, zinc oxide, magnesium oxide, mixtures thereof and so forth; and lubricants, e.g., stearic acid and glycerol monostearate, graphite, carbon, molybdenum disulfide, wax beads, calcium carbonate, calcium fluoride and mixtures thereof. Note that fillers may be functional (e.g., grinding aids such as lubricant, porosity inducers, and/or secondary abrasive grain) or more inclined toward non-functional qualities such as aesthetics (e.g., coloring agent). In a specific implementation, the filler includes potassium fluoroborate and/or manganese compounds, e.g., chloride salts of manganese, for instance an eutectic salt made by fusing manganese dichloride (MnCl.sub.2) and potassium chloride (KCl), available, from Washington Mills under the designation of MKCS.

In many instances the amount of filler is in the range of from about 1 and about 30 parts by weight, based on the weight of the entire composition. In the case of abrasive discs, the level of filler material can be in the range of about 5 to 25 parts by weight, based on the weight of the disc.

In specific embodiments the abrasive grains are fused alumina-zirconia abrasives, alumina abrasives, and the bond includes phenolic resins and fillers.

Curing or cross-linking agents that can be utilized depend on the bonding material selected. For curing phenol novolac resins, for instance, a typical curing agent is hexa. Other amines, e.g., ethylene diamine; ethylene triamine; methyl amines and precursors of curing agents, e.g., ammonium hydroxide which reacts with formaldehyde to form hexa, also can be employed. Suitable amounts of curing agent can be in the range, for example, of from about 5 to about 20 parts by weight of curing agent per hundred parts of total novolac resin.

Effective amounts of the curing agent that can be employed usually are about 5 to about 20 parts (by weight) of curing agent per 100 parts of total novolac resin. Those of ordinary skill in the area of resin-bound abrasive articles will be able to adjust this level, based on various factors, e.g., the particular types of resins used; the degree of cure needed, and the desired final properties for the articles: strength, hardness, and grinding performance. In the preparation of abrasive wheels, a preferred level of curing agent is about 8 parts to about 15 parts by weight.

The wheel, or mix layer(s) thereof, can be formed to include at least 20 vol % bond material of the total volume of the wheel (or a specific mix layer). A greater content of bond material, such as at least about 30 vol % at least about 40 vol %, at least about 50 vol %, or even at least about 60 vol % can be utilized. With respect to abrasive grains, the wheel (or a given mix layer thereof) contains at least about 20 vol % abrasive grains, e.g., at least about 35 vol %, at least about 45 vol %, at least about 55 vol %, at least about 60 vol %, or at least about 65 vol %.

The reinforced bonded abrasive articles described herein can be fabricated to have a desired porosity. The porosity can be set to provide a desired wheel performance, including parameters such as wheel hardness, strength, and initial stiffness, as well as chip clearance and swarf removal. Porosity can be uniformly or non-uniformly distributed throughout the body of the wheel and can be intrinsic porosity, obtained by the arrangement of grains within the bond matrix, shape of the abrasive grains and/or bond precursors being utilized, pressing conditions and so forth, or can be generated by the use of pore inducers. Both types of porosity can be present.

The porosity can be closed and/or interconnected (open). In "closed" type porosity void pores or cells generally do not communicate with one another. In contrast, "open" porosity presents pores that are interconnected to one another. Examples of techniques that can be used for inducing closed and interconnected porosities are described in U.S. Pat. Nos. 5,203,886, 5,221,294, 5,429,648, 5,738,696 and 5,738,697, 6,685,755 and 6,755,729, each of which is herein incorporated by reference in its entirety.

Finished bonded abrasive articles may contain porosity within the range of from about 0 vol % to about 40 vol % (based on the total volume of the article). In some implementations, the porosity of abrasive wheels described herein (or of a mix layer thereof) is within the range of from about 0 vol % to about 30 vol %, e.g., not greater than 25 vol %, often not greater than about 20 vol %, such as not greater than about 15 vol %, about 10 vol %, or not greater than about 5 vol %. In particular instances, the porosity is within a range between about 1 vol % and about 25 vol %, such as between about 5 vol % and 25 vol %.

Aspects of the invention are further illustrated by the following examples which are not intended to be limiting.

EXEMPLIFICATION

Example 1

Several 125 (OD)×3.2 (thickness)×22.3 (ID) mm depressed center wheels, as shown in FIG. 2D, with different formulations and initial stiffness values were subjected to the loading technique described herein. The load applied was selected to effect a stiffness reduction. In all cases the stiffness of the wheels was reduced with respect to initial stiffness and the wheels displayed an increase in pliability. Initial stiffness and the stiffness achieved after the loading process for wheels A through D are shown in Table 1 below.

TABLE 1

| Sample | Initial Stiffness | Post Loading Stiffness | Stiffness Reduction |
|---|---|---|---|
| A | 443 | 144 | 67.5% |
| B | 435 | 185 | 57.5% |
| C | 355 | 174 | 50.1% |
| D | 549 | 183 | 66.7% |

The experiments indicated that stiffness could be reduced in all cases and that formulation has no influence on the post-loading pliability or stiffness of the wheel.

Example 2

The grinding performance (under the same grinding conditions) was evaluated on eight of 125×3.2×22.3 mm depressed center wheels from the same batch. Four of them went through the loading process described herein, and four of them did not go through the loading process. Each data point presented below is an average of four measurements. The results with respect to the Q ratio (g/g) are shown in Table 2 below:

TABLE 2

| | Stiffness (N/mm) | Q Ratio (g/g) |
|---|---|---|
| No Loading | 422 | 6.4 |
| Post Loading | 151 | 9.9 |

The results demonstrate the effect of decreased stiffness on grinding performance. Higher Q-ratio means that more material can be removed by the wheel.

Example 3

Sound levels during grinding were studied on the 125×3.2×22.3 mm depressed center wheels with or without subjecting to the loading process described herein. Two values were used for the loading force: 850 N and 1250 N. Results are shown in Table 3 below and each data point below is an average of two measurements.

TABLE 3

| | Stiffness (N/mm) | Sound level (dB) |
|---|---|---|
| No Loading | 556 | 102 |
| Loaded @ 850N | 164 | 100.1 |
| Loaded @ 1250N | 88.5 | 98.5 |

The data indicate that the reduced stiffness and the corresponding increase in the pliability of the wheel obtained by the loading process described herein resulted in reduced sound levels during grinding.

Example 4

This example provides details of curves obtained for two resin-bonded depressed center wheels having the same formulation, dimension (125×3.2×22.3 mm), surface pattern, and a construction such as that of FIG. 2D ($V_1a_1V_2a_2$).

Pre- and post-loading data are presented in Table 4 below. Stiffness changed from 431 to 118 N/mm.

TABLE 4

| Patterned Working | Linear Region | | Serration Region | |
|---|---|---|---|---|
| Surface | Force | Deflection | Force Range | Deflection Range |
| Pre- | 0 to 723 | 0 to 1.68 | 723 to 739 | 1.68 to 4.86 |
| Post- | 0 to 829 | 0 to 5.39 | Removed by loading process | |

Example 5

Data obtained for two resin-bonded depressed center wheels having the same formulation, dimension (125×3.2×22.3 mm), and a construction according to FIG. 2D ($V_1a_1V_2a_2$), but without a surface pattern, are shown in Table 5 below. Stiffness changed from 658 to 272 N/mm.

TABLE 5

| Flat (non-patterned) Working | Linear Region | | Serration Region | |
|---|---|---|---|---|
| Surface | Force | Deflection | Force Range | Deflection |
| Pre- | 0 to 830 | 0 to 1.56 | 830 to 748 | 1.56 to 3.37 |
| Post- | 0 to 856 | 0 to 4.72 | Removed by loading process | |

Example 6

The burst speed (under the same testing conditions) was evaluated on twenty 125×3.2×22.3 mm depressed center wheels with the same formulation, same construction, and same surface pattern. Ten of them went through the loading process described herein, and the load used was 850 N. The other ten were not subjected to the loading process. The results with respect to the burst speed (m/s) are shown in Table 6 below. Each data point presented in this table is an average of ten measurements.

TABLE 6

| | Burst Speed (m/s) | Stiffness (N/mm) |
|---|---|---|
| Pre-Loading | 214 | 342 |
| Post-Loading | 212 | 150 |

The results demonstrate that the loading process did not affect the burst speed, as both sets of wheels displayed essentially the same burst speed. In contrast, the two sets of wheels displayed a marked difference in their stiffness. For all wheels, the burst speeds are higher than required by the standards of either EN12413 at 144 m/s or ANSI B7.1-2000 at 140.8 m/s.

Example 7

The fracture/rupture (under the same testing conditions) was evaluated on twenty of 125×3.2×22.3 mm depressed center wheels with same formulation, same construction, and same surface pattern. Ten of them were subjected to the loading process described herein, and the load used was 850 N. The other ten did not go through the loading process. The testing was conducted by pushing the wheel hub region till the visible fracture of the wheel occurred. The span used was 110 mm. Each data point presented below is an average of ten measurements. The results with respect to the fracture/rupture load (N) (FIG. 4) are shown in Table 7 below:

TABLE 7

| | Rupture Point (N) | Stiffness (N/mm) |
|---|---|---|
| Pre-Loading | 2061 | 293 |
| Post-Loading | 2120 | 127 |

The results also demonstrate that the loading process did not affect the fracture load. Both sets of wheels had essentially the same rupture point yet differed considerably with respect to stiffness.

While this invention has been particularly shown and described with references to preferred embodiments thereof, it will be understood by those skilled in the art that various changes in form and details may be made therein without departing from the scope of the invention encompassed by the appended claims.

In the foregoing, reference to specific embodiments and the connections of certain components is illustrative. As such, the above-disclosed subject matter is to be considered not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description. Moreover, the foregoing is not intended to establish a hierarchy of features which define the invention. Rather the above description details distinguished features, any combination of which may be used to define the true scope of the present invention.

The Abstract of the Disclosure is provided to comply with Patent Law and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description of the Drawings, with each claim standing on its own as defining separately claimed subject matter.

The invention claimed is:

1. A method for reducing the stiffness of an organically bonded abrasive wheel, the method comprising using a controlled loading process to apply a force to a raised hub region of a reinforced depressed center wheel, wherein the force applied is effective to irreversibly decrease the stiffness of said wheel and wherein the force applied is selected by calculating the force required to produce a targeted stiffness.

2. The method of claim 1, wherein the depressed center wheel has a working face devoid of patterned features.

3. The method of claim 1, wherein the depressed center wheel has a patterned working face, a patterned non-working face, or both a patterned working face and a patterned non-working face.

4. The method of claim 1, wherein the depressed center wheel has one or more reinforcements.

5. The method of claim 4, wherein the depressed center wheel has at least one fiberglass web reinforcement.

6. The method of claim 5, wherein the fiberglass web reinforcement has a tensile strength of at least about 200 megaPascal.

7. The method of claim 1, wherein the depressed center wheel does not include a fiberglass web reinforcement at the working face of the wheel.

8. The method of claim 1, wherein the force applied is within the range of from about the critical load to about 60% of the fracture load.

9. The method of claim 1, wherein the force applied is selected using a correlation of stiffness as a function of the load exerted for the depressed center wheel or for a wheel having the same specification.

10. The method of claim 1, wherein the force is applied in a single cycle.

11. The method of claim 1, wherein the force is applied in two or more repeated pulses.

12. The method of claim 1, wherein the depressed center wheel has a thickness within the range of from about 1.5 mm and about 6 mm.

13. The method of claim 1, further comprising determining a reduction in stiffness in the depressed center wheel by comparing a deflection-load curve for the depressed center wheel with a deflection-load curve for a conventional depressed center wheel of the same specification, wherein an absence of a serration region in the former and a presence of a serration region in the latter indicate that the depressed center wheel has reduced stiffness in comparison to said conventional depressed center wheel.

* * * * *